US011020626B2

(12) United States Patent
Yu et al.

(10) Patent No.: US 11,020,626 B2
(45) Date of Patent: Jun. 1, 2021

(54) ELLIPTICAL MACHINE WITH FUNCTION OF FREELY CONTROLLING THE LATERAL MOVEMENT OF THE PEDAL

(71) Applicants: Chao-Chi Yu, Taichung (TW); Cheng-Ru Yu, Taichung (TW)

(72) Inventors: Chao-Chi Yu, Taichung (TW); Cheng-Ru Yu, Taichung (TW)

( * ) Notice: Subject to any disclaimer, the term of this patent is extended or adjusted under 35 U.S.C. 154(b) by 7 days.

(21) Appl. No.: 16/426,910

(22) Filed: May 30, 2019

(65) Prior Publication Data

US 2020/0376325 A1 Dec. 3, 2020

(51) Int. Cl.
*A63B 22/00* (2006.01)
*A63B 22/06* (2006.01)

(52) U.S. Cl.
CPC ..... *A63B 22/0017* (2015.10); *A63B 22/0664* (2013.01); *A63B 2022/0676* (2013.01)

(58) Field of Classification Search
CPC ..... A63B 22/0007; A63B 22/001; A63B 22/0015; A63B 22/0017; A63B 22/0664; A63B 2022/0071; A63B 2022/0074; A63B 2022/0676; A63B 69/0022; A63B 69/0024; A63B 69/0026; A63B 69/18; A63B 69/182; A63B 69/187; A63B 2244/18; A63B 2244/183; A63B 2244/186; A63B 2244/19; A63B 22/00–2022/0043; A63B 23/035–2023/0452; A63B 22/0056–0076
See application file for complete search history.

(56) References Cited

U.S. PATENT DOCUMENTS 8,979,713 B2 * 3/2015 Huang ..... A63B 22/0023 482/52
10,675,504 B2 * 6/2020 Chang ..... A63B 22/001
2005/0266964 A1 * 12/2005 Teng ..... A63B 22/0061 482/71
2006/0046902 A1 * 3/2006 Chang ..... A63B 69/18 482/52
2007/0027001 A1 * 2/2007 Alessandri ..... A63B 23/0488 482/51
2007/0225130 A1 * 9/2007 Maffei ..... A63B 23/0482 482/71

(Continued)

*Primary Examiner* — Megan Anderson
*Assistant Examiner* — Kathleen Vermillera
(74) *Attorney, Agent, or Firm* — Egbert Law Offices, PLLC

(57) ABSTRACT

An elliptical machine includes: a transmission mechanism disposed a the base, one end of the lateral swing track disposed on both sides is pivoted at the base, and each lateral swing track can swing laterally; a connecting rod and a stepping mechanism are disposed on both sides of the transmission mechanism, and the front end of the front connecting rod in each mechanism is pivotally connected to the base; a front end is connected to the rear connecting rod of the front connecting rod in a universal joint type, the rear connecting rod is disposed on the corresponding track; the rear connecting rod free end part is pivoted to the pedal. When the pedal is stepped on, the front connecting rod is reciprocally extended with the transmission mechanism, and the user can freely manipulate the swing angle of the lateral swing track through the lateral force applied to the pedal.

5 Claims, 15 Drawing Sheets

(56) References Cited

U.S. PATENT DOCUMENTS

| | | | | |
|---|---|---|---|---|
| 2008/0146417 | A1* | 6/2008 | Chang | A63B 22/0064 482/70 |
| 2008/0214362 | A1* | 9/2008 | Eschenbach | A63B 22/0664 482/52 |
| 2008/0312044 | A1* | 12/2008 | Chen | A63B 22/0064 482/52 |
| 2009/0176624 | A1* | 7/2009 | Chang | A63B 22/001 482/52 |
| 2011/0105280 | A1* | 5/2011 | Jhang | A63B 22/0664 482/52 |
| 2012/0004077 | A1* | 1/2012 | Chu | A63B 22/001 482/52 |
| 2013/0123083 | A1* | 5/2013 | Sip | A63B 23/0222 482/145 |
| 2014/0194253 | A1* | 7/2014 | Huang | A63B 22/0023 482/52 |
| 2016/0361588 | A1* | 12/2016 | Kuo | A63B 22/0015 |
| 2017/0274244 | A1* | 9/2017 | Chang | A63B 22/001 |
| 2019/0192900 | A1* | 6/2019 | Smith | A63B 22/0664 |

* cited by examiner

ELLIPTICAL MACHINE WITH FUNCTION OF FREELY CONTROLLING THE LATERAL MOVEMENT OF THE PEDAL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an elliptical machine, and more particularly to an innovative structure wherein the lateral movement of the pedal can be freely controlled according to the user's force application mode.

2. Description of Related Art Including Information Disclosed Under 37 CFR 1.97 and 37 CFR 1.98

Because of the busy life in modern days, most people feel very tired when they get home, not having spare energy to exercise. After the rise of leisure and health, the concept of physical fitness has become popular. However, finding the suitable place for sports is another problem for people who want to exercise. In terms of the popular choices of school playgrounds and parks, although they are convenient and free, they are easily affected by the weather and cannot be exercised. In view of this, the sports equipment industry has developed a variety of sports and fitness devices that are convenient for indoor use, so that the users can utilize spare time and achieve indoor exercise and fitness.

In the wide range of sports equipment, because the running trajectory of the elliptical machine pedal can simulate the movement trajectory of the foot and the leg when walking, it is more ergonomic, so it is favored by many consumers. However, the running trajectory of the two pedals of the currently commercial available elliptical machine is limited to two planes parallel to each other, so that the part of the exercise is fixed, and the corresponding relationship between the two pedal movement trajectories cannot be changed according to different force applying modes of the user.

BRIEF SUMMARY OF THE INVENTION

The present invention mainly aims to provide an elliptical machine with function of freely controlling the lateral movement of the pedal, and the technical problem to be solved is to how to develop a more ideal and practical new elliptical machine structure which the lateral movement of the pedal can be freely controlled, it is an innovative breakthrough as the goal.

The technical feature of the present invention is mainly to solve the problem that the elliptical machine comprises: a base, which is in a forward-backward extension and comprises a front frame part and a rear frame part, and virtualizes a forward and backward axis as well as a side axis according to the base type; an upright column is fixed on the front frame part of the base; a transmission mechanism is mounted on the front frame part of the base, the transmission mechanism comprises a bracket and a flywheel screwed on the bracket by a rotating shaft, and two ends of the rotating shaft are respectively fixed with a crank, each crank has a free end part, and the free end part is fixed with a pivot; two lateral swing tracks are respectively disposed on the rear frame part of the base in the left and right interval arrangement relationship. Each lateral swing track comprises a pivot end and a swing section. The pivot end is pivoted at a fixed position of the rear frame part, and the swing section extends a length along the anteroposterior axis, so that the swing section is in a displaceable state on the rear frame part, and forms that when the swing section is controlled by an external force, it takes the pivot end as a pivot point, and it is in a left and right lateral arc track freely-swinging state along the lateral axis direction; and a pair of connecting rod and stepping mechanisms. Each of the pair of connecting rod and the stepping mechanisms are disposed on corresponding sides of the transmission mechanism, and both are in a mutually interlocking relationship. Each connecting rod and the stepping mechanism comprises a front connecting rod, its bottom end is pivoted to the base, and one side of the front connecting rod body is pivoted to the corresponding pivot disposed by the crank; a rear connecting rod, its front end is connected to the rear end of the front connecting rod in a universal transmission type, and the rear end of the rear connecting rod is disposed on the corresponding lateral swing track; a pedal with a screwing particular for being screwed to a corresponding rear end part of a rear connecting rod, which forms that the pedal takes the screwing part as a pivot point in a rotatable state by force, and the pedal group is provided with an angle suppression limit device, so that the rotation of the pedal can be limited to a set angle range.

With said structural composition and technical features, when the user steps on each pedal, the flywheel is driven by each front connecting rod, and the front connecting rod is reciprocally extended with the rotation angle of the flywheel and the crank, thereby causing the movement of each pedal in the elliptical trajectory, and the user can selectively apply the lateral force on the pedal through the feet, freely and separately to manipulate the swing section of the lateral swing track in the left and right lateral arc track swing, thereby greatly improving the action type and exercise fitness effect of the elliptical machine to use, so as to meet the practical progress of multiple needs.

DETAILED DESCRIPTION OF THE INVENTION

Figure 1:
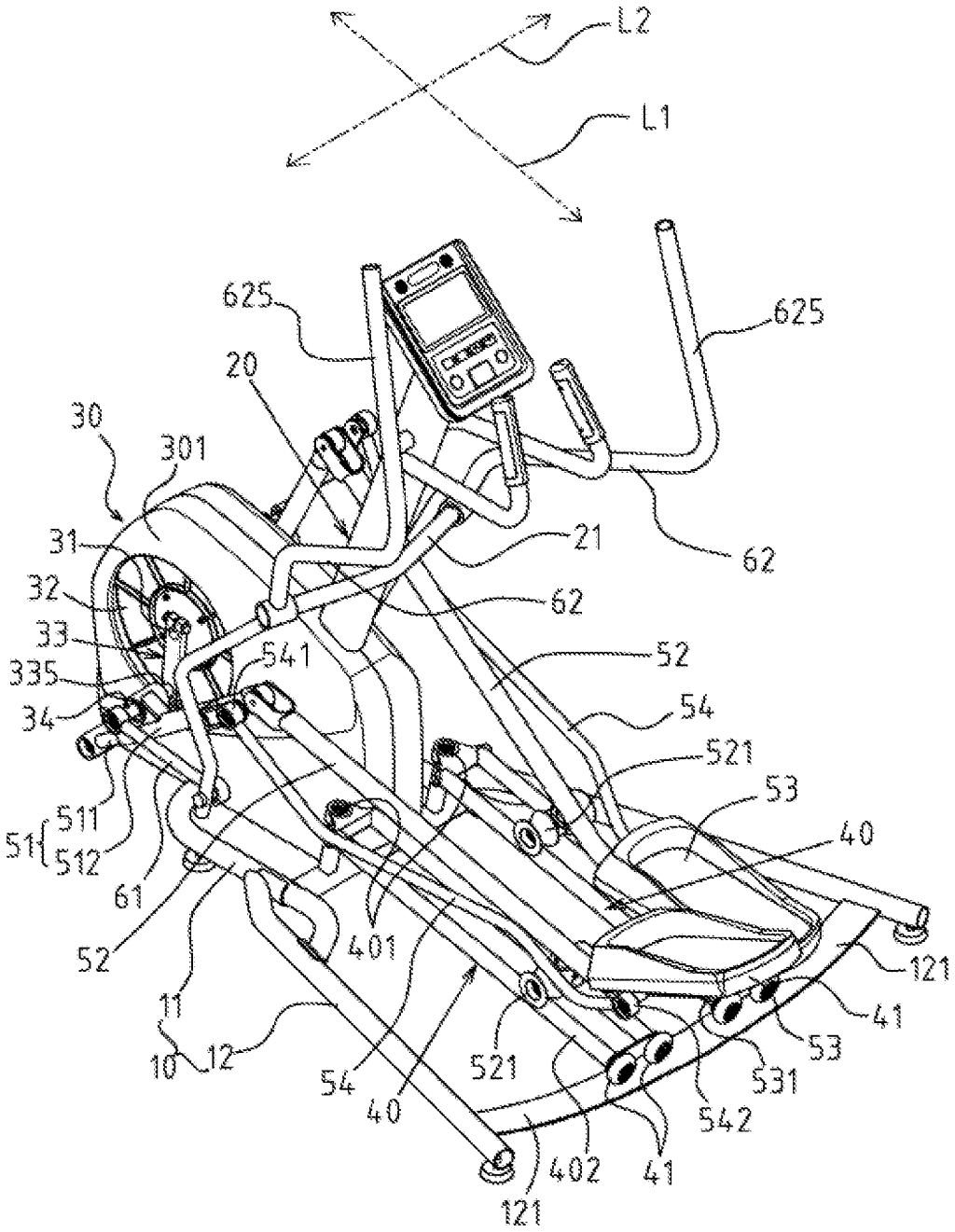
FIG. 1 is a three-dimensional outside view of a preferred embodiment of the present invention.

Referring to FIG. 1-FIG. 5 for preferred embodiments of the elliptical machine with the function of freely controlling the pedal lateral movement of the present invention, but the embodiments are for illustrative purposes only, and they are not limited by this structure in patent application.

The elliptical machine comprises the following structures a base 10 with a front frame part 11 and a rear frame part 12 in a forward-backward extension mode, and a front-rear axis L1 and a lateral axis L2 virtualized according to the type of the base 10; an upright column 20 fixed on the front frame part 11 of the base 10; a transmission mechanism 30 mounted on the front frame part 11 of the base 10, the transmission mechanism 30 comprises a bracket 301 and a flywheel 32 disposed in the bracket 301 by a rotating shaft 31, wherein two ends of the rotating shaft 31 are fixed respectively with a crank 33, each crank 33 has a free end part 335, and the free end part 335 is fixed with a pivot 34; two lateral swing tracks 40 are disposed on the rear frame part 12 of the base 10 in a left and right interval arrangement relationship. Each lateral swing track 40 comprises a pivot end 401 and a swing section 402, wherein the pivot end 401 is pivoted in a fixed position of the rear frame part 12, the swing section 402 extends a length along the front-rear axis L1, so that the swing section 402 is placed on the rear frame part 12 in a displaceable state. When the swing section 402 is controlled by an external force, the pivot end 401 is used as a pivot point, it is in the leftward and rightward arc track free swing state; a pair of connecting rod and stepping mechanisms 50 disposed on one corresponding sides of the transmission mechanism 30, so that both are interlocked with each other; each of the pair of connecting rod and stepping mechanisms 50 comprise: a front connecting rod 51, the bottom end is pivotally disposed on the base 10, the rod body side of the front connecting rod 51 is pivotally disposed on the corresponding pivot 34 in the crank 33; a rear connecting rod 52, the front end is connected to the rear end of the front connecting rod 51 in universal transmission type; the rear connecting rod 52, the rear end is disposed on the corresponding lateral swing track 40; a pedal 53, the pedal 53 has a joint part 531 for being screwed on the rear end part of the corresponding rear connecting rod 52, so that the pedal 53 takes the joint part 531 as a pivot point in the forced rotation state, and the pedal 53 is provided with an angle suppression limit device 54 for setting the rotation inhibition limit of the pedal 53 within a set angle range.

Preferably, the front connecting rod 51 comprises a first long member 511 and a second long member 512. The first long member 511 and the second long member 512 are axially combined with each other in a retractable state. The bottom end of the first long member 511 is pivoted at the base 10; one side of the second long member 512 is pivotally disposed on the pivot 34 corresponding to the crank 33, and the second long member 512 is axially reciprocated relative to the first long member 511 when the crank 33 is rotated, thereby changing the length of the front connecting rod 51, and the rear connecting rod 52 is connected to the rear end of the second long member 512.

Figure 2:
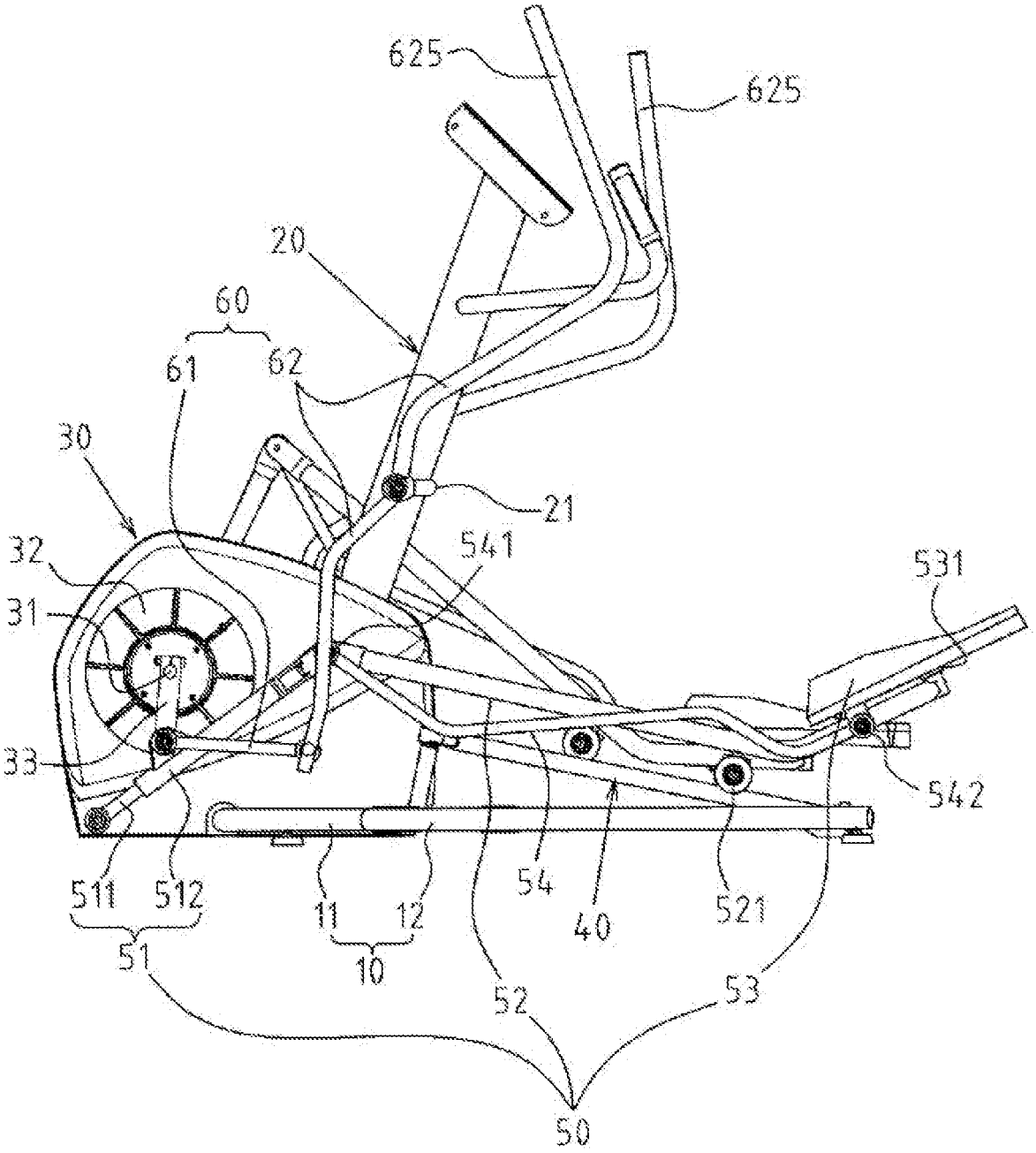
FIG. 2 is a lateral view of a preferred embodiment of the present invention.
Figure 3:
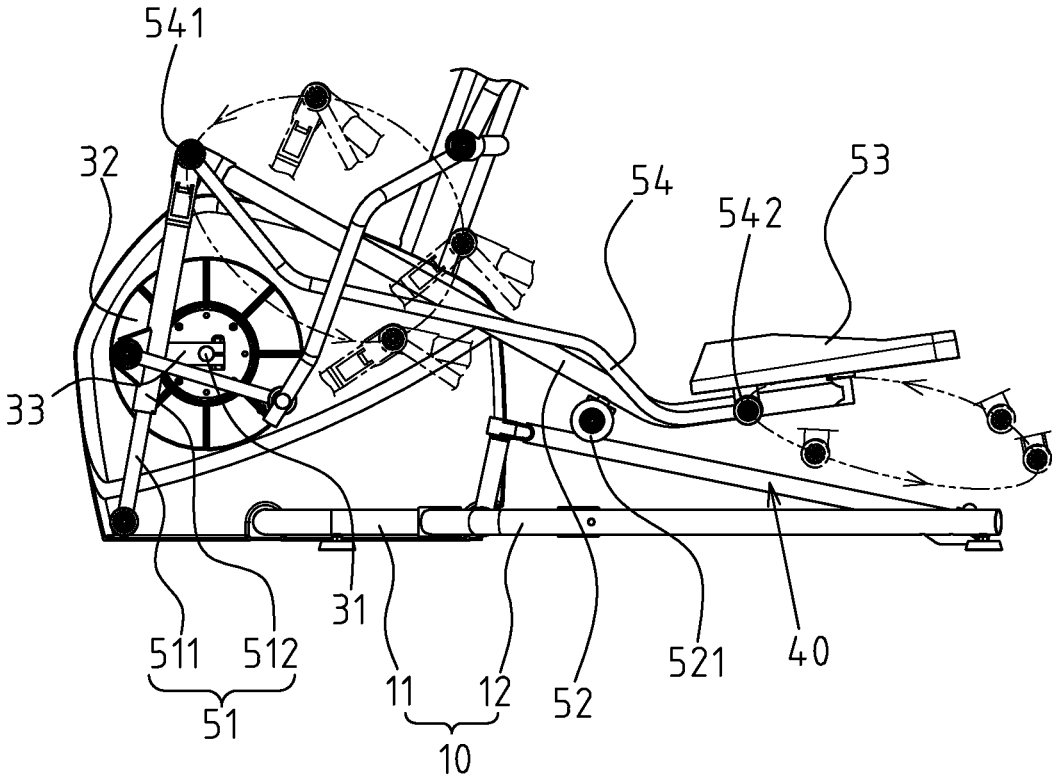
FIG. 3 is an action trajectory schematic diagram of a preferred embodiment of the present invention.
Figure 6:
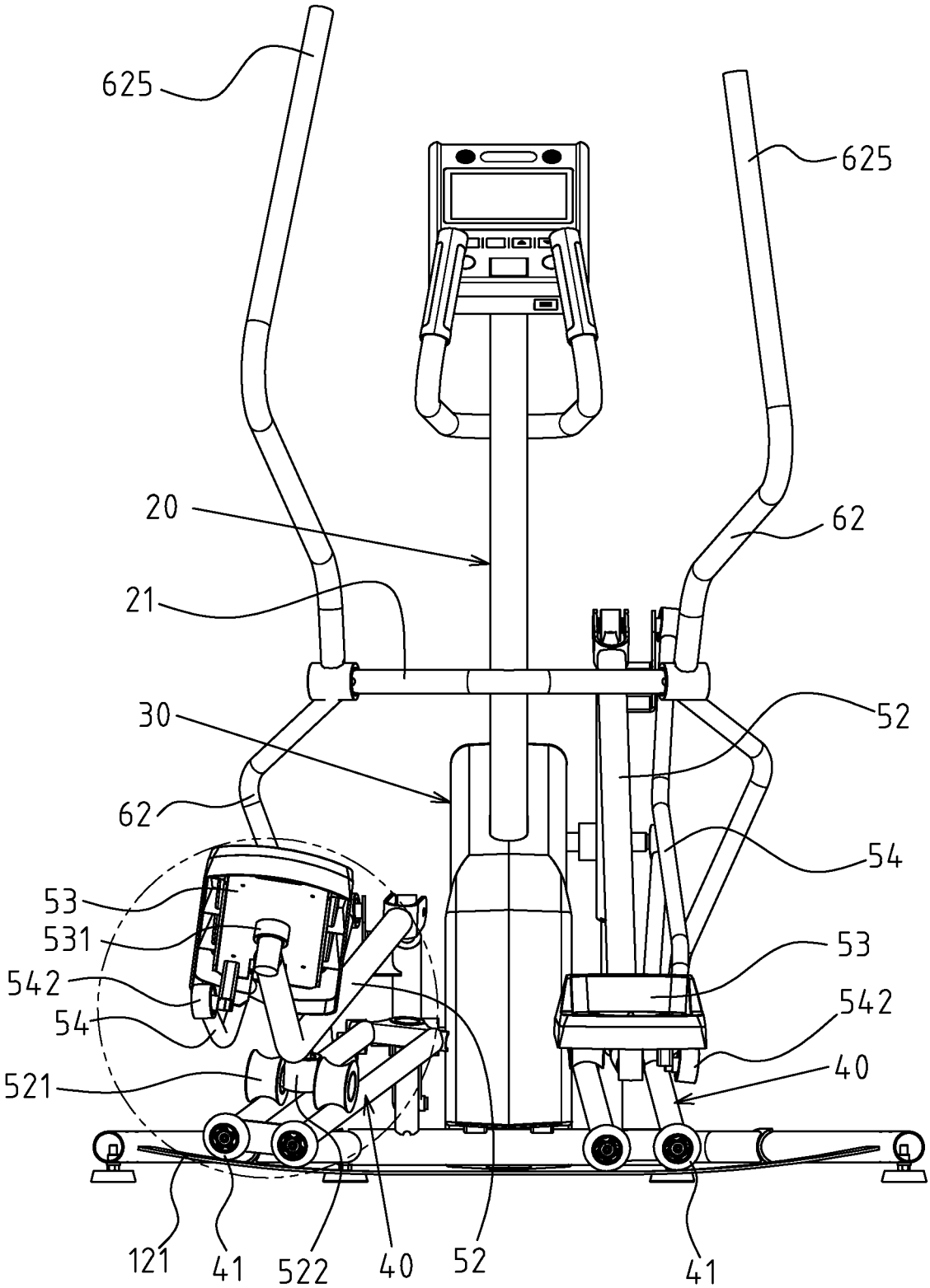
FIG. 6 is a back view of two lateral swing tracks at different deflection angle.
Figure 6A:
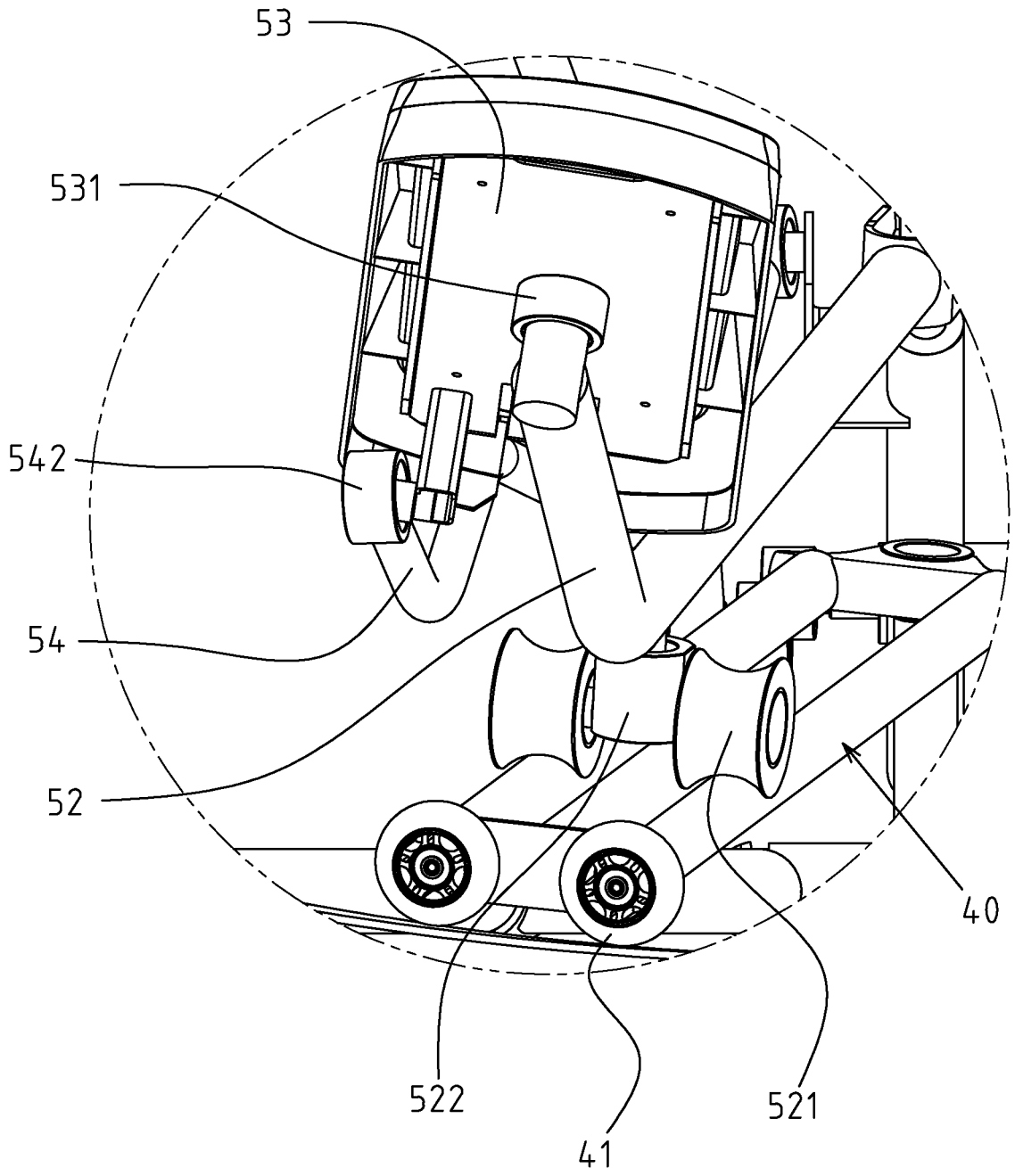
FIG. 6A is a partial enlargement diagram of FIG. 6.
Figure 7:
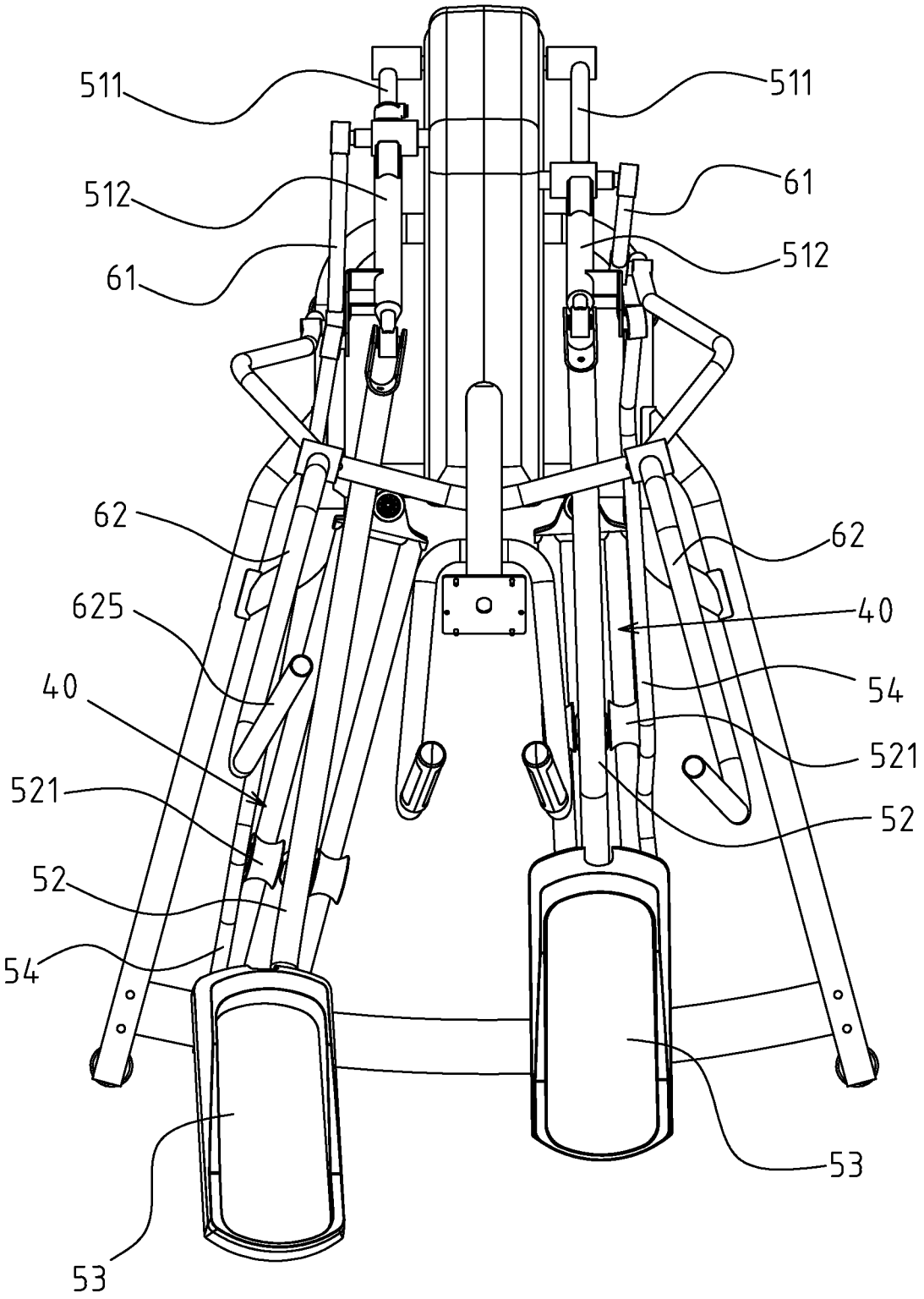
FIG. 7 is a top view of two lateral swing tracks at different deflection angle.
Figure 8:
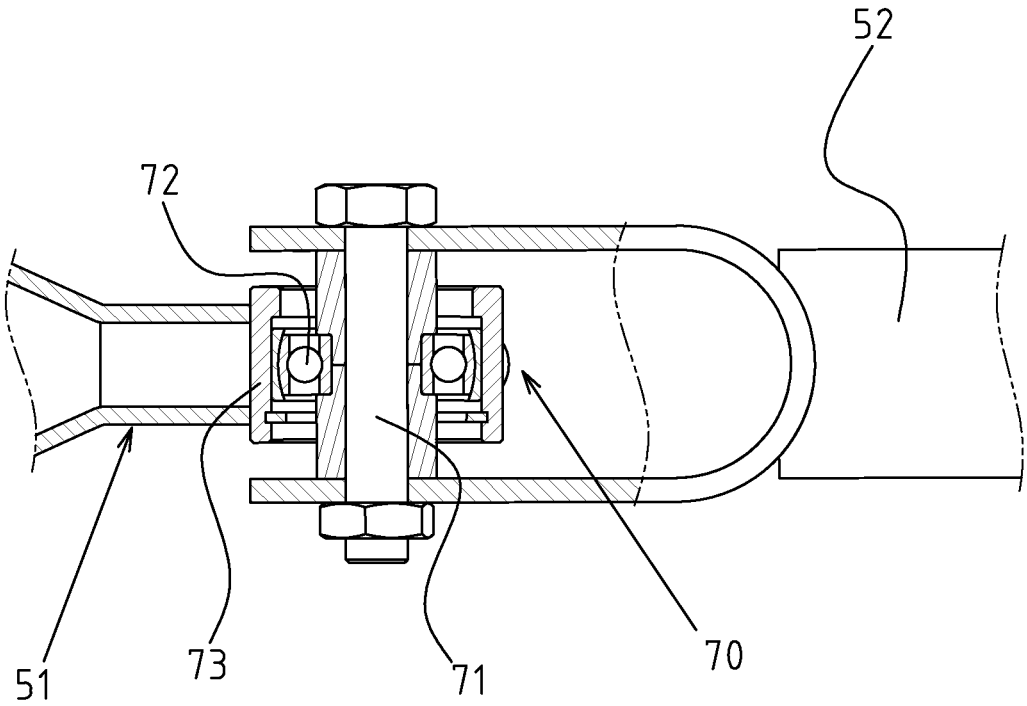
FIGS. 8-9 are action schematic diagrams of universal joint disposed between front connecting rod and rear connecting rod of the present invention.

With said structural composition and technical features, as shown in FIGS. 1, 2 and 3, when the user steps on each pedal 53, the flywheel 32 is driven by each front connecting rod 51, and the front connecting rod 51 is reciprocally extended with the rotation angle of the flywheel 32 and the crank 33, hereby causing the movement of each pedal 53 in the elliptical trajectory, and the user can selectively apply the lateral force on the pedal 53 through the feet, freely and separately to manipulate the swing section 402 of the lateral swing track 40 in the left and right lateral arc track swing (described later in detail); Referring to FIG. 8, at this time, the universal joint 70 is perpendicular to the axis of the front connecting rod 51. The greatest difference between the present invention and the currently commercially available elliptical machine is mainly that two lateral swing tracks 40 are additionally disposed in left and right lateral arc track free swing state along the direction of the lateral axis L2, for this part, Referring to FIGS. 4 and 4A. When two lateral swing tracks 40 are not deflected outward, the state between each pedal 53 and its corresponding rear connecting rod 52 is shown as FIGS. 5~7. When the user steps on the two pedals 53, one of the pedals 53 (or the two pedals 53) can be selectively forced by the lateral power at the same time, so that the lateral swing track 40 can be driven in the left and right lateral arc track swing, so as to achieve the exercise and fitness effect of different muscle groups in the leg. In addition, since the two lateral swing track 40 systems are respectively independently pivoted on the base 10, they do not interfere with each other during the action, so that the deflection angle of two lateral swing tracks 40 and the movement track of the pedal 53 can be freely deflected with the user's force. In addition, the pedal 53 equipped with the angle suppression limit device 54 can limit the rotation of the pedal 53 to a set angle, so as to avoid the safety concerns due to the relatively large offset of the corresponding rear connecting rod 52.

As shown in FIG. 1, in this example, the angle suppression limit device 54 is a rod type extending along the front-rear axis L1, and the angle suppression limit device 54 has a front rod end 541 and a rear rod end 542, the front rod end 541 is connected to the rear section of the second long member 512 of the front connecting rod 51 in a universal transmission type, and the rear rod end 542 is connected to the bottom of the corresponding pedal 53 in a universal transmission type, and this place is spaced from the joint part 531 of the pedal 53. Therefore, when the swing section 402 of each lateral swing track 40 is in left and the right lateral arc track swing, the rotation of the pedal can be limited to a set angle range by the arrangement connection relationship of the angle suppression limit device 54, wherein the first long member 511 is in a rod type, and the second long member 512 is in a sleeve type disposed on the outer circumference of the first long member 511.

As shown in FIGS. 1, 2, in this example, a height position of the upright column 20 is further provided with a transverse frame rod 21, and the two ends of the transverse frame rod 21 extend toward the left and right sides and are equipped with two swing arm groups 60, each swing arm group 60 comprises an upper arm rod part 62 and a lower elbow rod part 61 in a mutual elbow connection relationship, wherein the upper arm rod part 62 is provided with a grip 625 adjacent to the upper end, the rod body of the upper arm rod part 62 is pivoted at the end of the corresponding transverse frame rod 21, and the front end of the lower elbow rod part 61 is pivoted to the corresponding pivot 34 of the crank 33.

As shown in FIGS. 1, 4, 5 and 6, in this example, the rear frame part 12 of the base 10 is provided with an arc track 121, and a lateral moving roller set 41 is mounted on the bottom side of the swing section 402 of each lateral swing track 40 (note: not limited to single or double wheel type), each lateral moving roller set 41 is rolled on the arc track 121.

Figure 4:
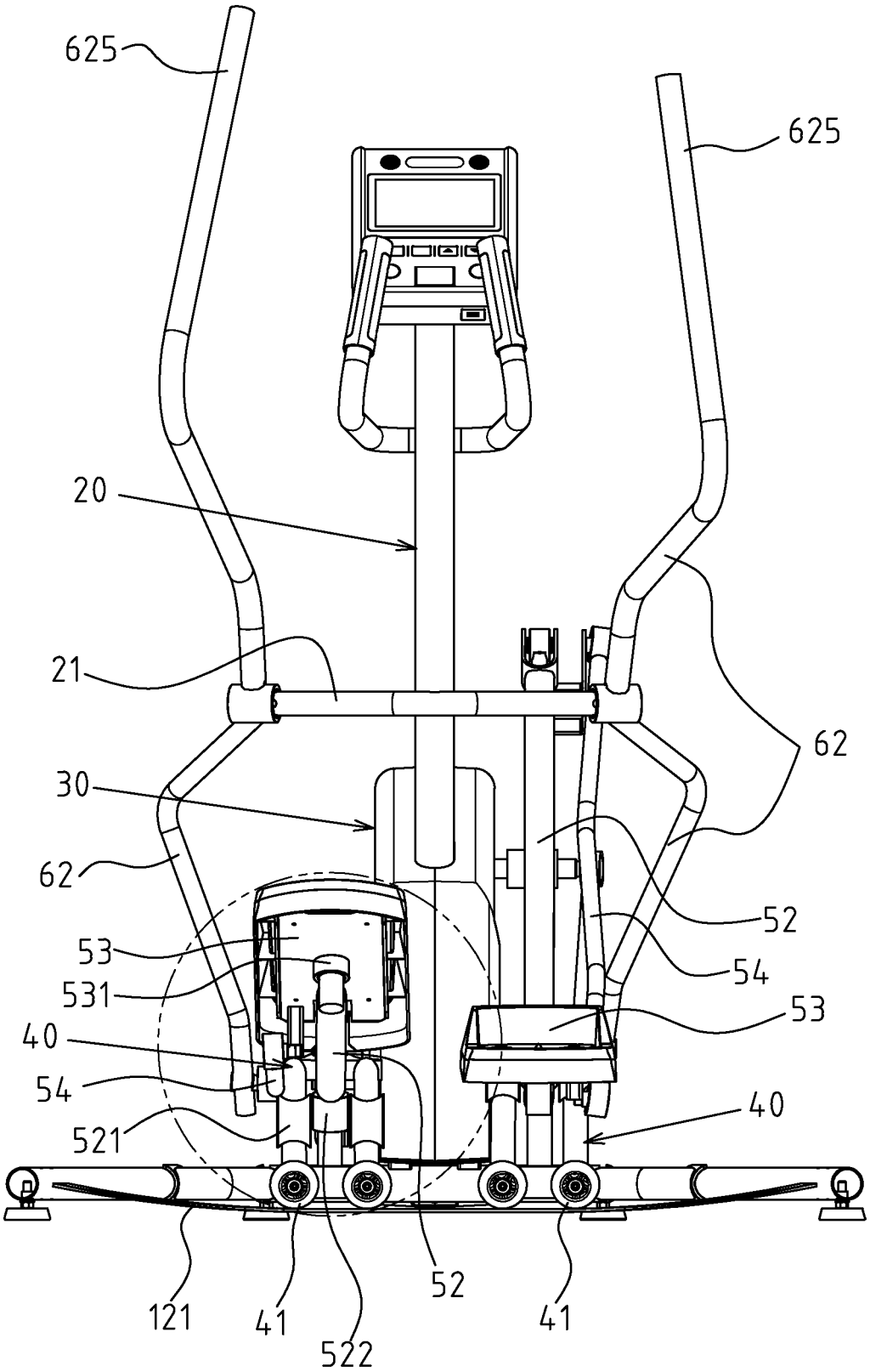
FIG. 4 is a back view of a preferred embodiment of the present invention.
Figure 4A:
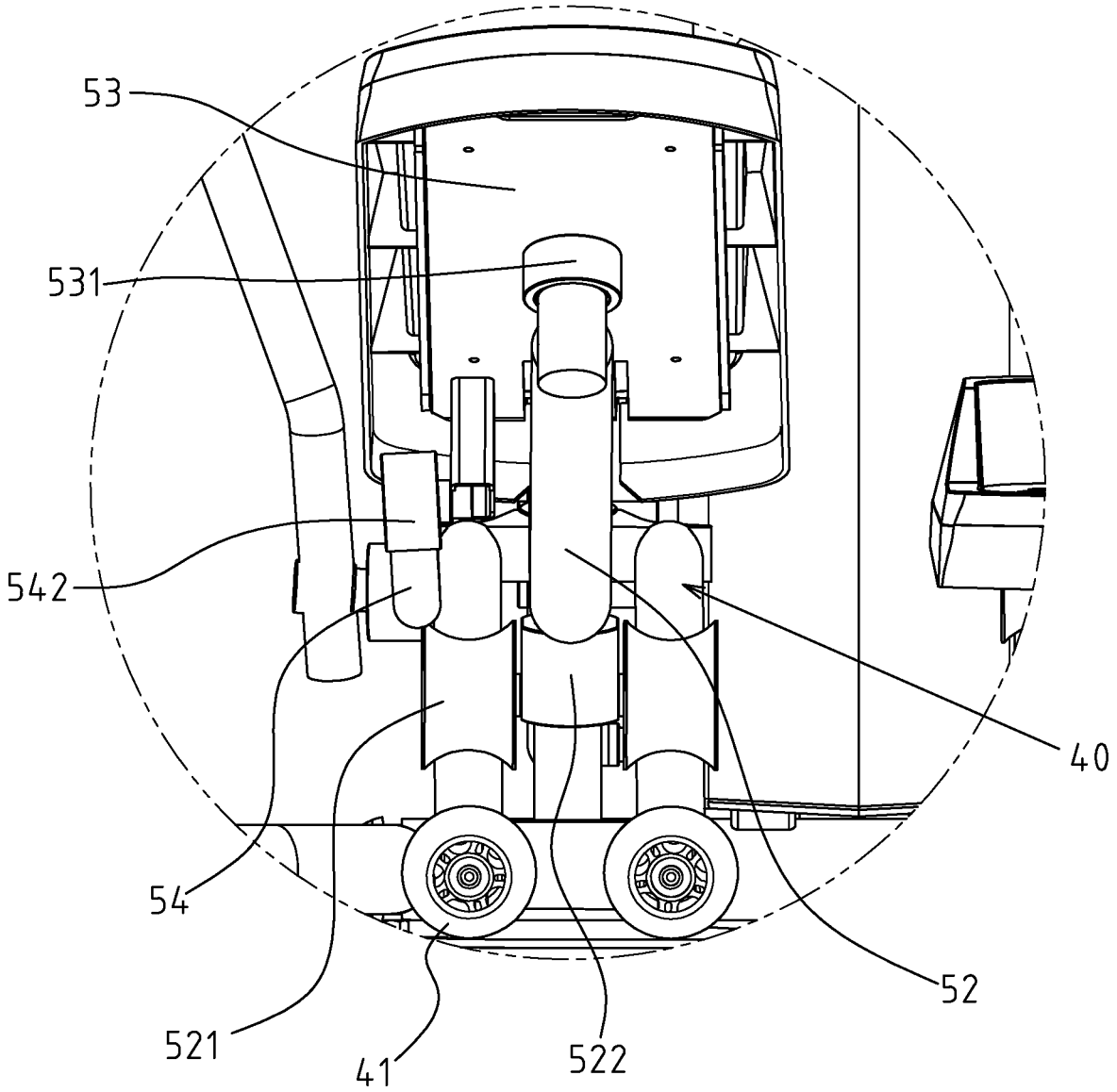
FIG. 4A is a partial enlargement diagram of FIG. 4.
Figure 5:
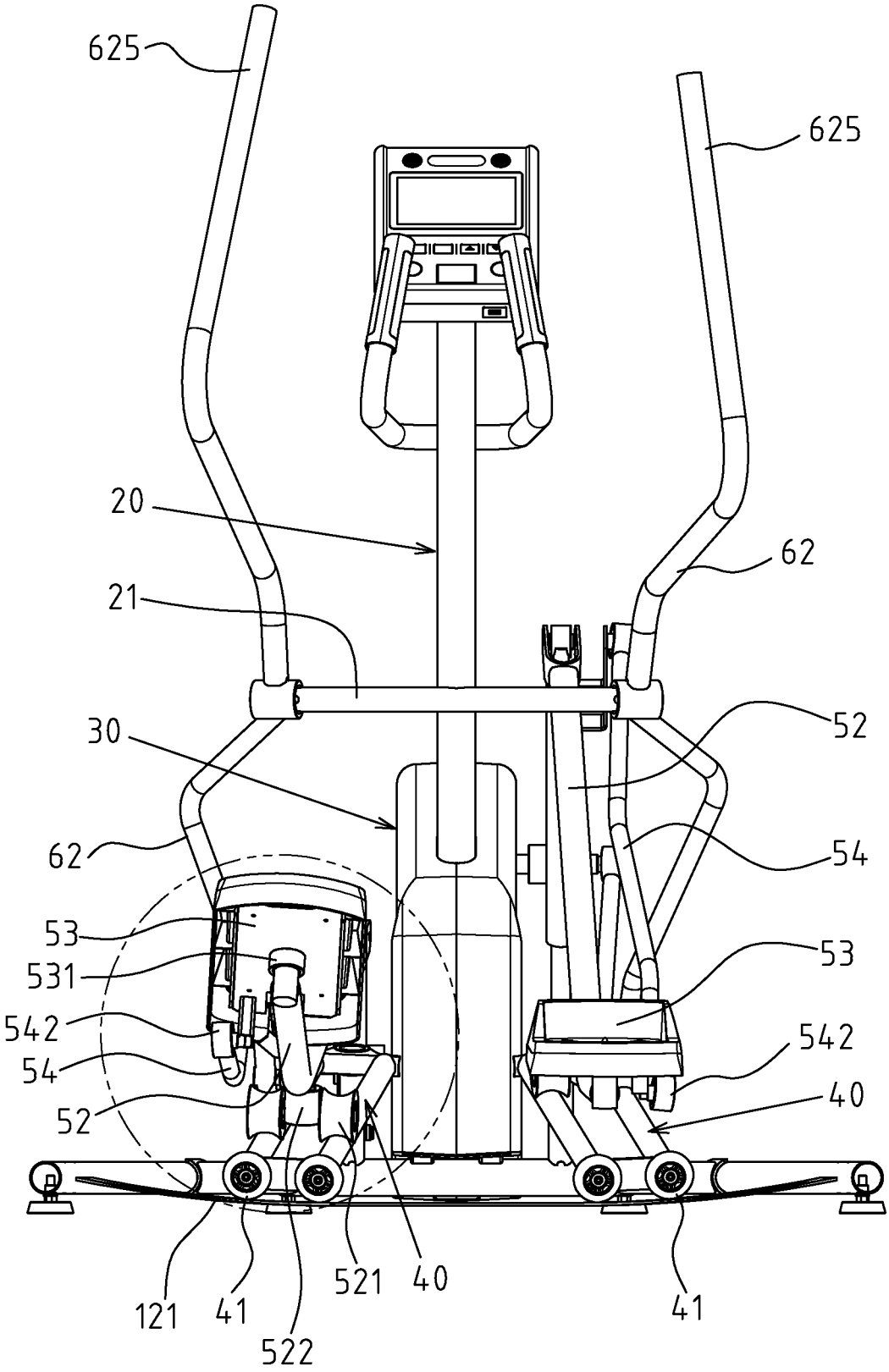
FIG. 5 is a back view of two lateral swing tracks at same deflection angle.
Figure 5A:
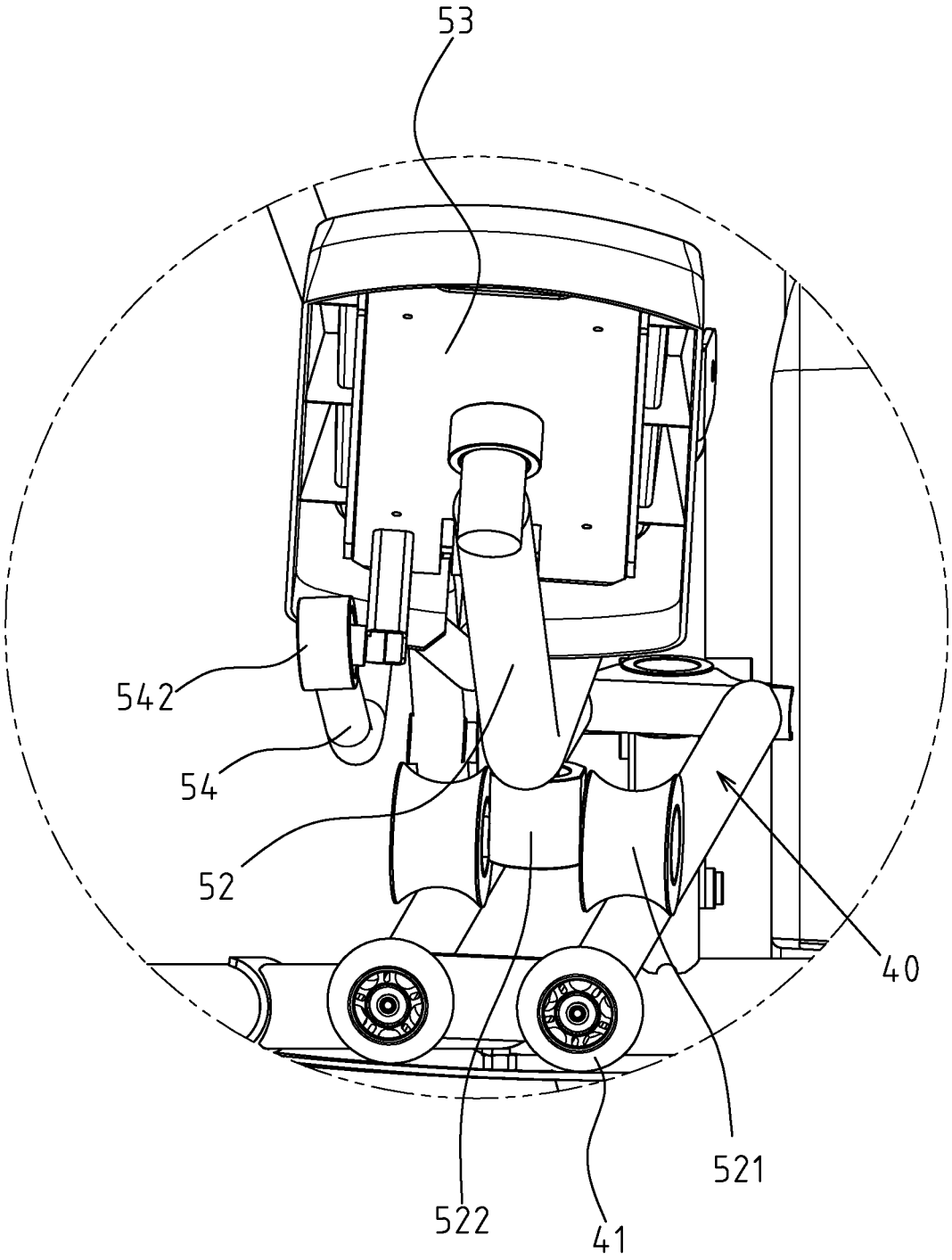
FIG. 5A is a partial enlargement diagram of FIG. 5.

As shown in FIG. 4A, in this example, each rear connecting rods 52 is further provided with a forward-backward moving roller set 521 (note: not limited to a single wheel or a double wheel type), the forward-backward moving roller set 521 is rolled on the corresponding lateral swing track 40, and a rotary joint 522 is provided between the forward-backward moving roller set 521 and the rear section of the rear connecting rod 52, so that when the forward-backward moving roller the set 521 is rolled on the lateral swing track 40, the rear connecting rod 52 can be deflected synchronously with the lateral swing of the rear connecting rod 52.

Figure 9:
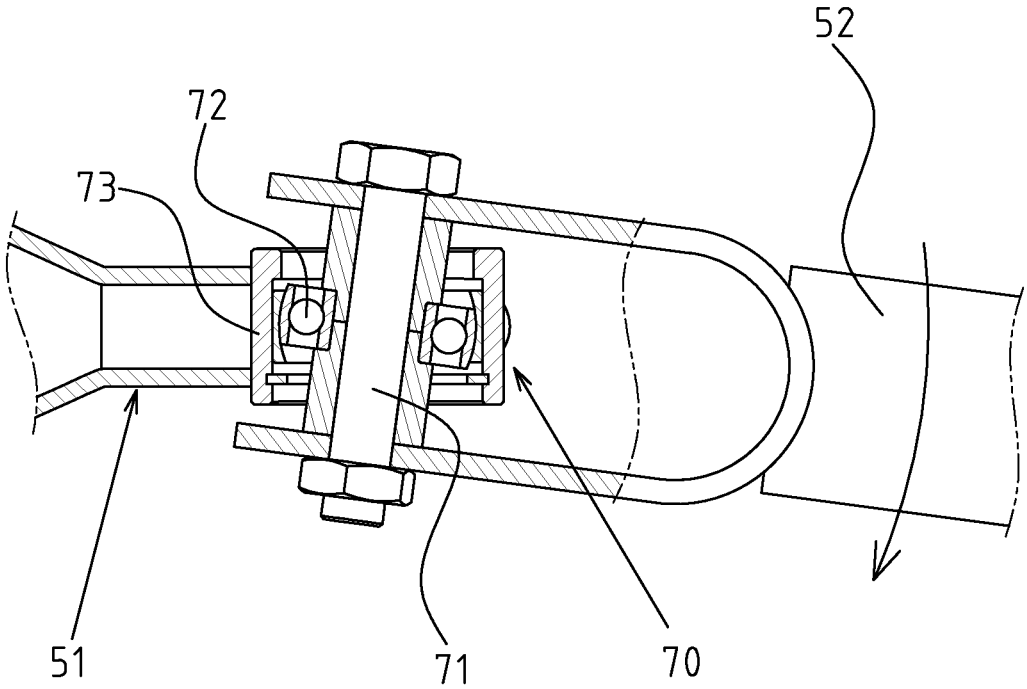

As shown in FIGS. 8 and 9, in this example, the front end of the rear connecting rod 52 is connected to the rear end of the front connecting rod 51 by a universal joint 70; the universal joint 70 comprises an axial rod 71 passing through a front end of the rear connecting rod 52, a universal bearing 72 disposed on the axial rod 71 and a bearing sleeve 73 disposed on the outer wall of the universal bearing 72, the bearing sleeve 73 is fixed at the rear end of the front connecting rod 51. The description to be added to this example is that: if the connector in a universal joint type is mentioned in the present invention, the specific structural details can be considered and specified in this example.

Figure 10:
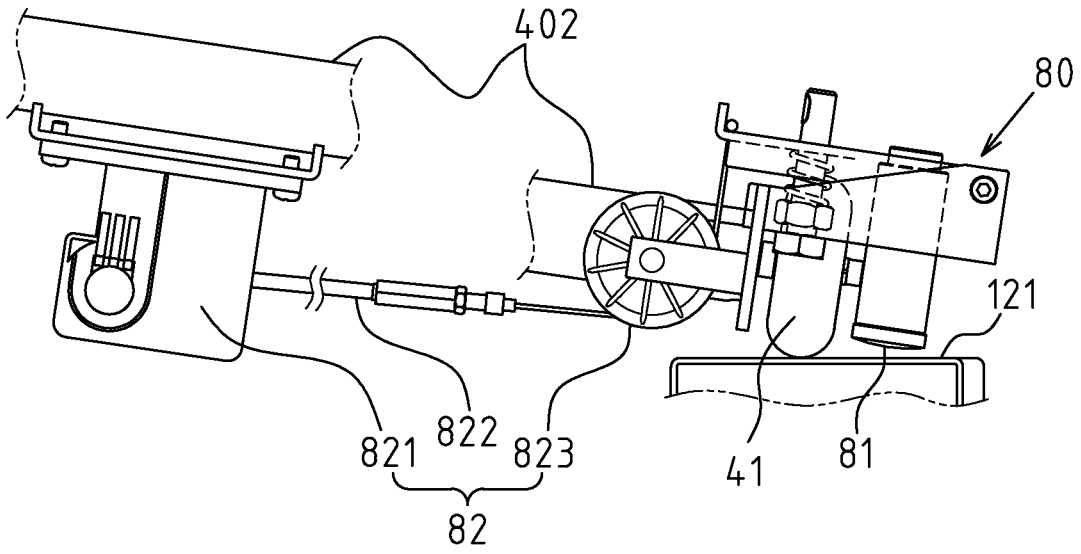
FIGS. 10-11 are action schematic diagrams of friction damper disposed in swing section group of the present invention.
Figure 11:
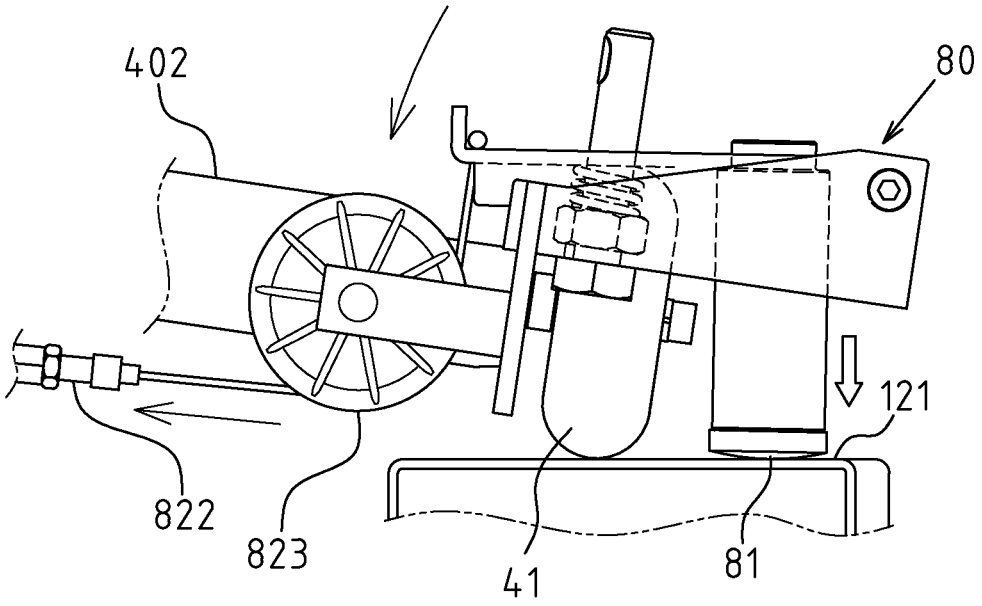

As shown in FIGS. 10, 11, the swing section 402 is further provided with a friction damper 80, which comprises a liftable friction part 81 and a brake member 82 for controlling the lifting state of the liftable friction part 81, and when the liftable friction part 81 is in the descending state, the frictional force is generated downwardly against the corresponding arc track 121, so that the rolling displacement of the lateral moving roller set 41 has resistance; in addition, the brake member 82 adopts any control mode of electric or manual mode. For example, the brake member 82 of the present embodiment adopts an electric control mode, which mainly comprises an electric drive 821, a bracing cable 822 and a rotating wheel 823, wherein the rear end of the bracing cable 822 is connected to one place of the liftable friction parts 81 by passing the rotating wheel 823. The electric drive 821 can be controlled to drive the bracing cable 822 and then to actuate the liftable friction part 81. It is only a preferred embodiment and is not limited thereto; in this example, the advantage of the friction damper 80 is mainly to control the friction force of the swing section 402 relative to the arc track 121 displacement, thereby providing more options for the user to operate the elliptical machine.

Figure 12:
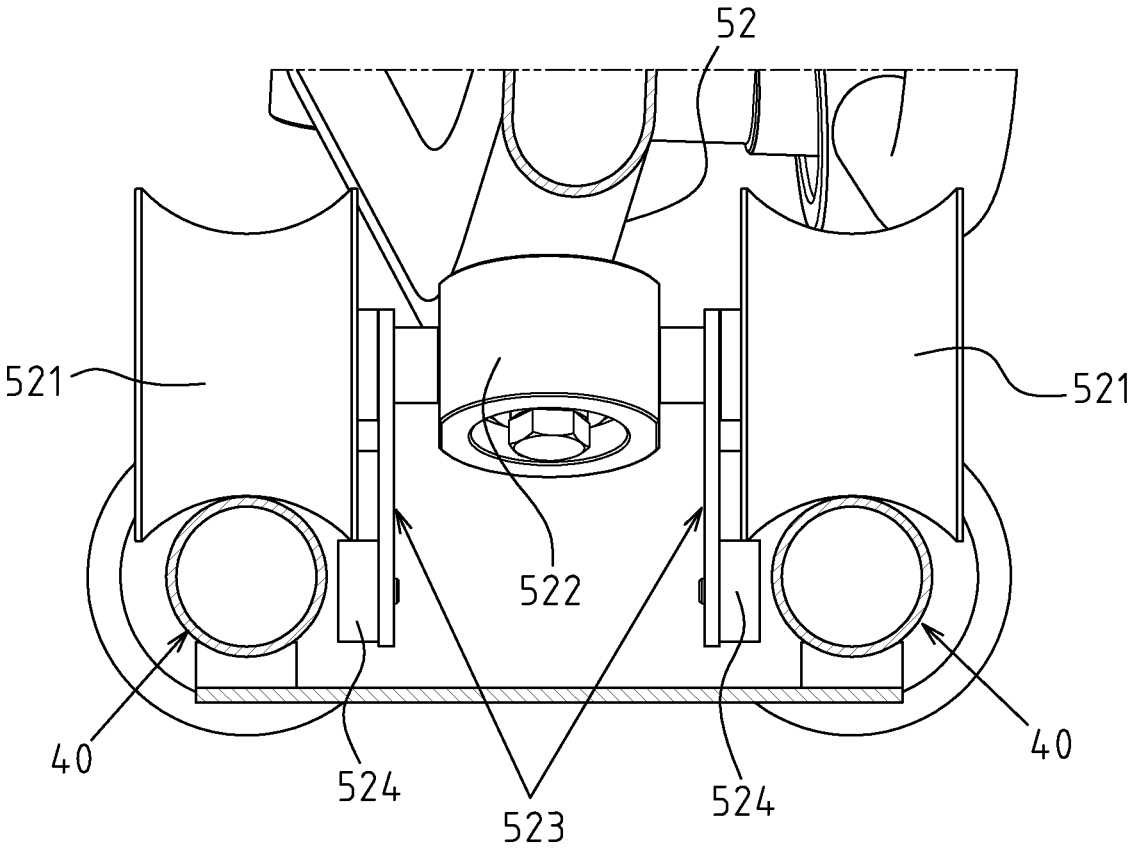
FIG. 12 is an embodiment of an anti-detachment limiting member disposed in front and rear moving roller set of the present invention.

As shown in FIG. 12, in this example, the forward-backward moving roller set 521 is further provided with an anti-detachment limit member 523. Said anti-detachment limit member 523 has at least one abutment frame part 524 for abutting against the side of the lateral swing track 40 to prevent the forward-backward moving roller set 521 from escaping out of the lateral swing track 40.

Figure 13:
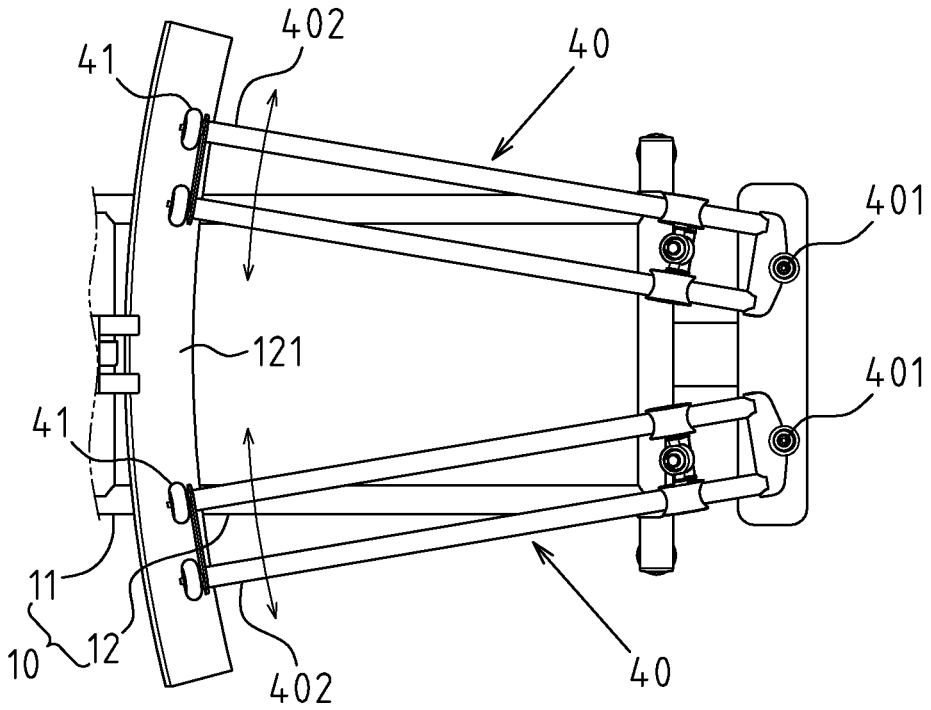
FIG. 13 is an embodiment of arrangement type disposed at rear end of pivot end and disposed at front end of swing section of the present invention.

As shown in FIGS. 1-7, in this example, the pivot end 401 and the swing section 402 of each lateral swing track 40 are in an arrangement type of the pivot end 401 at the front side and the swing section 402 at the rear side. As shown in FIG. 13, the pivot end 401 and the swing section 402 are in an arrangement type of the pivot end 401 at the rear side and the swing section 402 at the front side.

Figure 14:
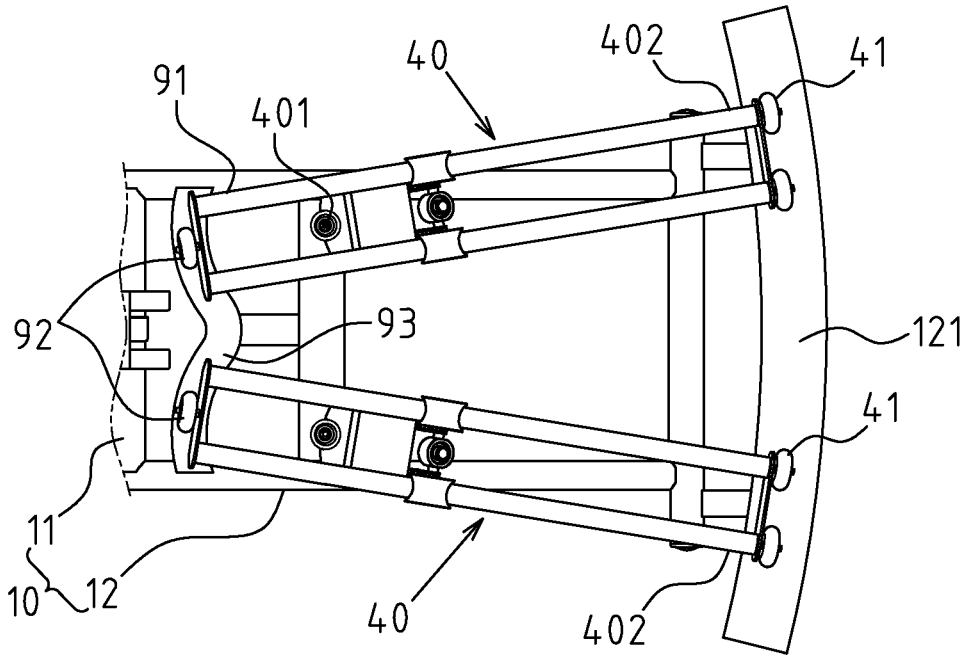
FIG. 14 is an embodiment of second swing section disposed at lateral swing track and second arc track disposed at rear frame part of the present invention.

As shown in FIG. 14, in this example, the pivot end 401 of each lateral swing track 40 keeps away from one end of the swing section 402 and further extends to form a second swing section 91, and the bottom of the second swing section 91 is provided with a second roller set 92, so that the rear frame part 12 of the base 10 is provided with a second arc track 93 for the second roller set 92 to roll and shift thereon.

Figure 15:
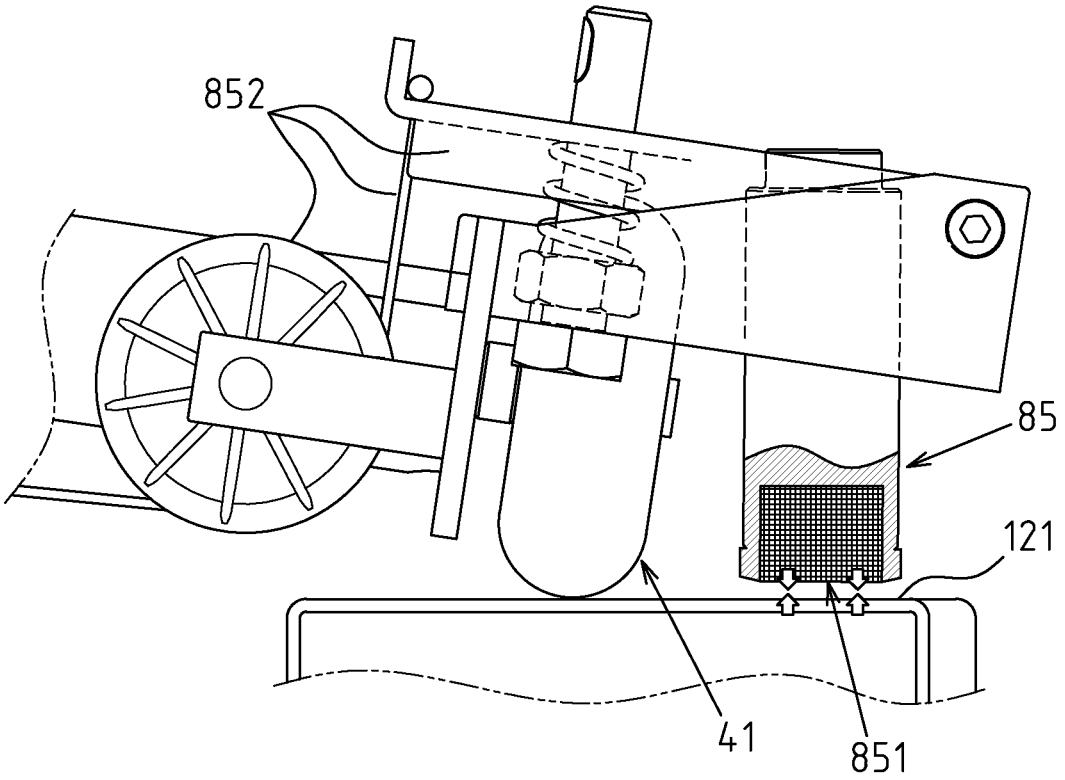
FIG. 15 is an embodiment of magnetic damper disposed at swing section set of the present invention.

As shown in FIG. 15, in this example, the swing section 402 is further provided with a magnetic damper 85, the magnetic damper 85 comprises a liftable magnetic part 851 and a brake member 852 for controlling the liftable magnetic part 851. The arc track 121 is composed of a magnetically permeable material, and when the liftable magnetic part 851 is in a descending state, a difference in the magnetic force (shown as a hollow arrow in the figure) is generated corresponding to the arc track 121, so that the lateral moving roller set 41 has a resistance adjustment function for rolling displacement; the brake member 852 adopts either electric or manual control mode.

We claim:

1. An elliptical machine comprising:

a base extending in a forward direction and a rearward direction, said base having a front frame part and a rear frame part;

an upright column fixed on the front frame part of said base;

a transmission mechanism mounted on the front frame part, said transmission machine having a bracket and a flywheel mounted to the bracket by a rotating shaft, the rotating shaft having opposite ends respectively fixed to a pair of cranks, each of the pair of cranks having a free end part, the free end part having a pivot;

a pair of lateral swing tracks respectively disposed on the rear frame part in spaced relationship, each of said pair of lateral swing tracks having a pivot end and a swing section, wherein the pivot end is pivoted at a fixed position on the rear frame part, the swing section extending for a length along a longitudinal axis of said base, wherein the swing section is displaceable with respect to the rear frame part, the pivot end being a rotating pivot point when the swing section is acted upon by an external force;

a pair of connecting rod and stepping mechanisms each being disposed on respective sides of said transmission mechanism so as to be interlocked with each other, each of said pair of connecting rod and stepping mechanisms comprising:

a front connecting rod having a bottom end pivoted to said base and a side pivoted to the pivot of a respective crank of the pair of cranks;

a rear connecting rod having a front end connected to a rear end of said front connecting rod, said rear connecting rod being disposed on a respective lateral swing track of the pair of lateral swing tracks; and a pedal having a joint part screwed to a rear end of said rear connecting rod, the joint part being a pivot point when said pedal is being rotated, said pedal having an angle suppression limit device adapted to limit a rotation of said pedal within a set angle range, wherein the flywheel is driven by said front connecting rod when a user steps on the pedal so as to cause the pedal to move in an elliptical manner.

2. The elliptical machine of claim 1, wherein the front connecting rod of each of the pair of connecting rod and stepping mechanisms comprises a first long member and a second long member, the first long member and the second long member being axially aligned and retractable with respect to each other, the first long member having the bottom end pivoted at said base, one side of said second long member being the side pivoted at the pivot of the respective crank of the pair of cranks, wherein the second long member generates an axially reciprocating movement with respect to the first long member when the respective crank of the pair of cranks rotates such that a length of said front connecting rod changes, wherein said rear connecting rod of each of the pair of connecting rod and stepping mechanisms is connected to a rear end of the respective second long member.

3. The elliptical machine of claim 2, wherein the angle suppression limit device of each of the pair of connecting rod and stepping mechanism comprises a rod that extends along the longitudinal axis of said base, the rod having a front rod end and a rear rod end, the front rod end being connected to a rear section of the second long member of said respective front connecting rod, the rear rod end being connected to a bottom of said respective pedal and spaced from the joint part of said respective pedal.

4. The elliptical machine of claim 3, wherein the first long member of the front connecting rod of each of the pair of connecting rod and stepping mechanisms is a rod, the second long member of the front connecting rod of each of the pair of connecting rod and stepping mechanisms being sleeved over an outer diameter of the respective first long member.

5. The elliptical machine of claim 4, wherein the rear frame part of said base has an arc track, the swing section of each of the pair of lateral swing tracks having a lateral moving roller set mounted on a bottom side thereof, wherein the lateral moving roller set is rollable and displaceable on the arc track.

* * * * *